United States Patent [19]

Jansz

[11] 4,069,683

[45] Jan. 24, 1978

[54] METHOD AND DEVICE FOR SECURING A SUPPORT STRUCTURE ONTO THE OCEAN FLOOR

[75] Inventor: Joost W. Jansz, The Hague, Netherlands

[73] Assignee: Hollandsche Beton Groep N. V., Rijswijk, Netherlands

[21] Appl. No.: 733,826

[22] Filed: Oct. 19, 1976

[30] Foreign Application Priority Data

July 5, 1976 Netherlands ..... 7607405

[51] Int. Cl.[2] ..... E02D 7/00

[52] U.S. Cl. ..... 61/98; 61/53.5; 61/94

[58] Field of Search ..... 61/53.5, 94, 53, 98; 175/220; 173/43, 28

[56] References Cited

U.S. PATENT DOCUMENTS

| | | | |
|---|---|---|---|
| 1,375,092 | 4/1921 | Hanson | 175/220 X |
| 2,969,121 | 1/1961 | Wallace | 175/220 X |
| 3,001,515 | 9/1961 | Haage | 61/53.5 X |
| 3,012,619 | 12/1961 | Farque | 173/28 X |
| 3,115,755 | 12/1963 | Siebenhausen | 61/94 |
| 3,282,356 | 11/1966 | Paulson et al. | 175/220 X |
| 3,483,708 | 12/1969 | Marshall | 61/94 |
| 3,827,508 | 8/1974 | MacKinnon | 61/53.5 |
| 3,832,858 | 9/1974 | Anders | 61/53.5 |
| 3,991,581 | 11/1976 | Kolb | 61/53.5 |

*Primary Examiner*—Dennis L. Taylor
*Attorney, Agent, or Firm*—Sughrue, Rothwell, Mion, Zinn and Macpeak

[57] ABSTRACT

One or more guide elements support a pile at the region where the chance of bending or collapse of the pile is most likely and during the process of pile driving, the guide element is moved along with the pile to eliminate the need for puncheons or the like.

7 Claims, 12 Drawing Figures

METHOD AND DEVICE FOR SECURING A SUPPORT STRUCTURE ONTO THE OCEAN FLOOR

FIELD OF THE INVENTION

The present invention relates to a method and device for securing a platform support, such as a framework in the form of a truncated pyramid, onto the ocean floor, said support structure at the region of the corners being provided with guide bushings through which the piles may be inserted and driven into the ground with the aid of a ram disposed on the top of the pile, in which during the process of pile driving the piles are supported transversely by guide means provided on the corner columns or ribs of the support structure.

DESCRIPTION OF THE PRIOR ART

With support structures which must be positioned onto the ocean floor and which have the form of a truncated pyramid, it is possible to secure the foot of said support structure onto the ocean floor with the aid of piles which are driven into the ground either vertically or parallel to the corner columns or ribs of the pyramid form. When pile driving is carried out in a direction parallel to the columns or ribs of the pyramid-shaped support, the piles on the columns are guided by means of guide elements, for example funnel-shaped guide eyes, secured to the piles at the distances one above the other. Thus, the piles are driven in the correct direction and the transverse forces acting on the pile find support. Inasmuch as it is not possible for the ram to pass the guide elements, since the dimensions of the ram in transverse direction are larger than the ones of the pile, one had to use puncheons, as a consequence of which pile driving is expensive and complicated. In addition, a large number of guide elements must be provided in order to obtain a fairly reasonable support in transverse direction.

SUMMARY OF THE INVENTION

It is the object of this invention to provide a solution for driving piles into the ocean floor in a simpler and faster way when securing a support structure of the kind mentioned above and in accordance with the invention, that object is achieved in that near each pile at least one guide element supports the pile at the region where the chance of bending and/or collapse is most likely and that, during the process of pile driving, the guide element is moved along with that region. Thus, in accordance with the invention, a movable support is used instead of a stationary one and during the process of pile driving said movable support means is moved such that it is always present at the region which is most favorable for supporting the pile.

In accordance with the invention, the guide element may be placed in saddle-shape fashion across a main column or corner rib of the support means and with the legs, present on the support at either side of the column or rib, displaceably guided in a direction parallel to the center line of the column or rib. The legs are preferably guided on guide sections, such as tubes, secured to the support means parallel to the center line of the column. Since the columns or ribs are inclined downwards the piles reposing parallel thereto in the guide elements will also be struck into the ground in inclined position, which, however, does not matter. Yet, the inclined position will lead to bending because of the dead weight of the piles and, in addition, during the process of pile driving, transverse forces may occur due to tolerances and currents. This is important, particularly for piles with a length of over 100 meters.

The legs of the guide elements may act on the guide sections in a slidable or movable manner. It is also possible to have the outer ends of the legs of the guide elements, guided on the sections, embrace said sections in such a manner that displacement is possible only parallel to the sections. It is, thus, possible to use a guide element also at the inner side of the corner columns, said element then being slidably suspended on guide sections present at the inner side of the framework.

It is preferred to use a second guide element in which the ram is secured. As the ram always seizes across the head of the pile, the head end is also held in its correct position.

Each guide element is preferably constructed with several elements for guiding a pile or taking a ram. It is, thus, possible to position several or all piles appertaining to a corner of the support structure to be secured. It is then possible to work with several piles at a time and to drive all piles into the ground at the same time, however, as a rule this will not be done and one will use only one ram. The piles are then driven into the ground one by one. In order to avoid that the guide element, which is moved each time for the right support, does not provide support any more to the piles that are not subjected to pile driving, another guide element may be disposed above the guide element carrying the ram with said second guide element supporting temporarily the upper end portions of the piles already positioned.

With this invention, it is not only possible to obtain the correct support during the process of pile driving but it is also possible to work without puncheons and with a ram that can be used under water. In addition, several operations of similar nature may be carried out before one need start with other ones, such as the positioning of the piles and driving each pile individually.

The guide elements are recovered and they may be re-used each time. By the fact that guide sections are used, said sections may function to provide strength to the support, i. e., they may form part of the framework, and they need not be removed. The sections may have a continuous profile, i. e. a cross-section being the same along the entire length. Corner columns of such frameworks are less suitable for that, since they will decrease in cross-sectional area towards the top.

With the known guide elements, which were provided along the corner columns at distances one above the other, each pile, and, thus, also each puncheon had to be lowered via the number of guide elements. With the device in accordance with the invention, this is not required any more, since the pile, being vertically suspended in the water, can be lowered in the open water space above the foot until the lower end portion of the pile has found the guide bushing, whereupon the pile may be placed laterally in the guide elements, which are present on the corner column or rib of the support structure.

The invention will now be described more in detail with reference to the accompanying drawings in which like elements bear like numerals.

DESCRIPTION OF THE PREFERRED EMBODIMENT

Figure 1:
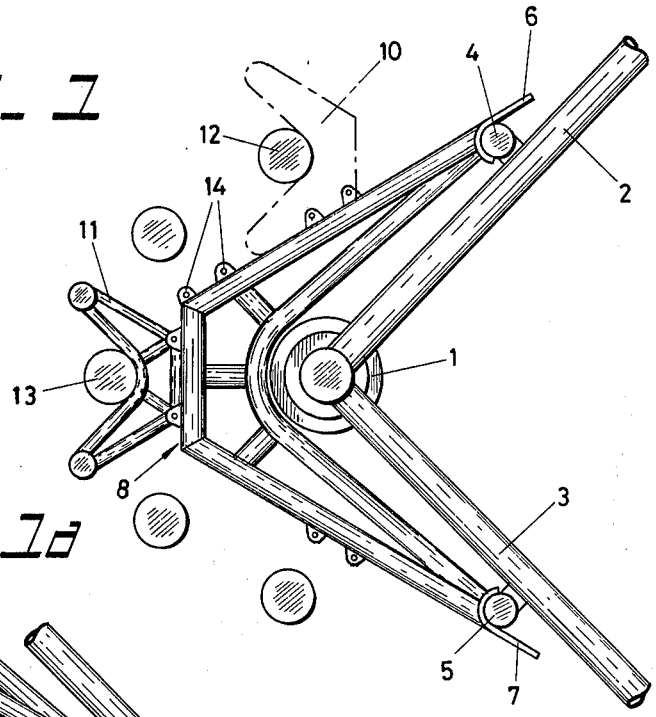
FIG. 1 is a top-plan view of a guide element in accordance with the invention.
Figure 1A:
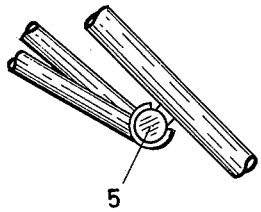
FIG. 1*a* is a top plan view of a portion of a guide element illustrating an alternative form for the guiding.

FIG. 1 shows a corner of a framework in the form of a truncated trapezium and of said corner. Only column 1 and a number of frame girders 2 and 3 are illustrated. Along the side faces of frame girders 2 and 3, tubes 4 and 5 are secured parallel to the center line of column 1 and a first saddle-shaped element indicated generally at 8 is guided on said tubes 4 and 5 with the aid of guide shoes 6 and 7 which are disposed on the outer ends of guide element 8. Said element 8, being suspended from a cable 9, is not in contact with column 1 but is only slidable along the tubes 4 and 5. Element 8 which comprises an open frame carries a number of chairs as at 10 and 11, for receiving piles 12 and 13 and connecting pieces 14 are present on element 8 for securing other chairs or for chairs that have been moved.

Figure 2:
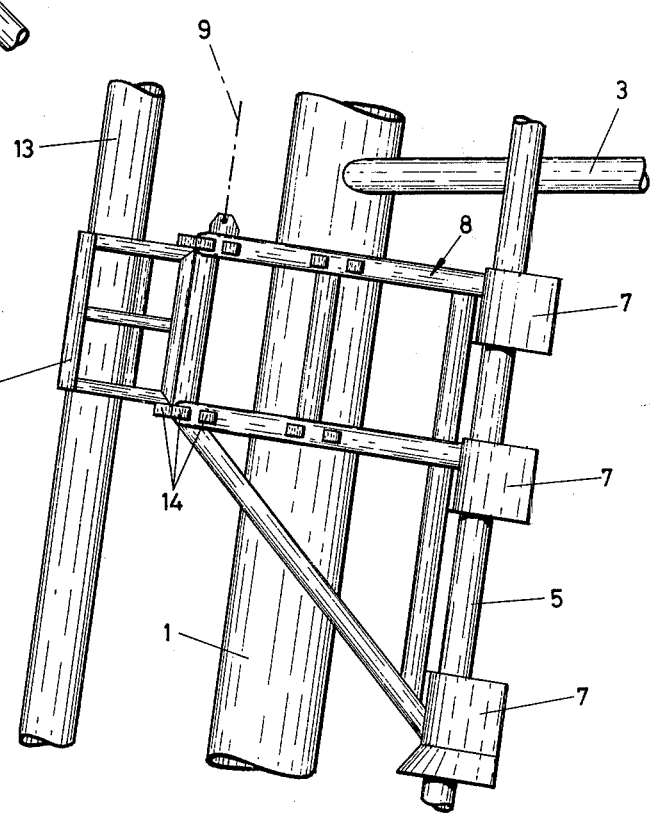
FIG. 2 is a side elevational view of the device illustrated in FIG. 1.
Figure 3:
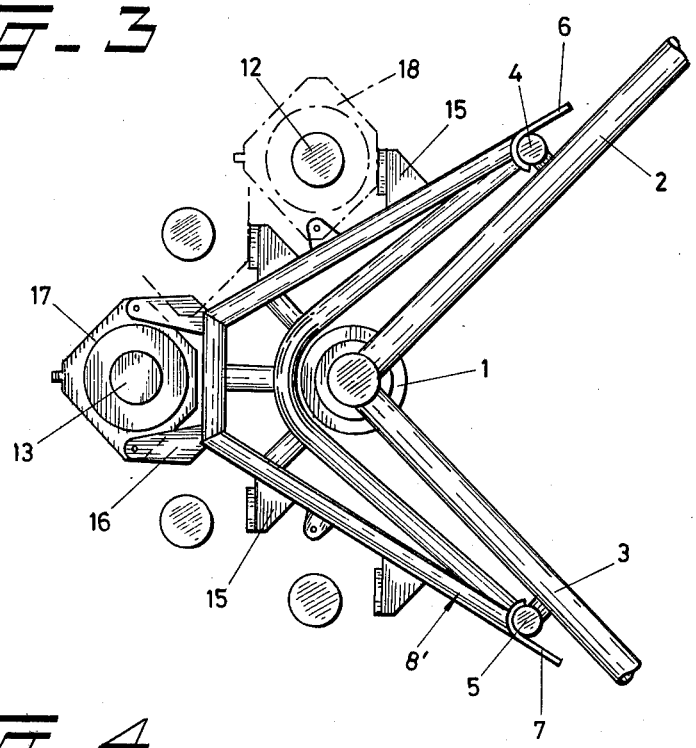
FIG. 3 is a plan view of a guide element of the invention with means for receiving a pile hammer.
Figure 4:
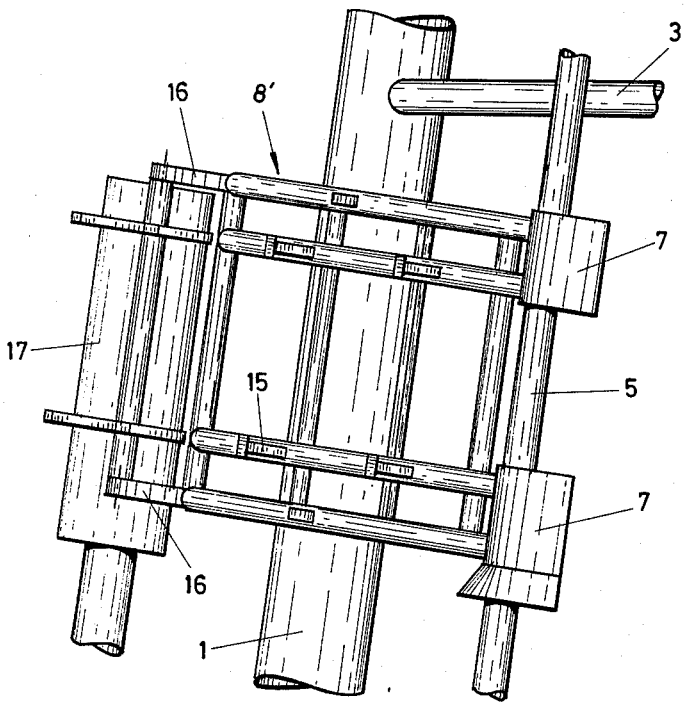
FIG. 4 is a side elevational view of the device illustrated in FIG. 3.

The second embodiment of guide element 8′ may be seen in FIGS. 3 and 4 and is comparable to the one of FIGS. 1 and 2. The difference consists in that instead of the chairs, means have been provided, such as chocks 15, 16 to secure a pile hammer. Reference numerals 17 and 18 indicate pile hammers.

FIGS. 5 to 11 inclusive illustrate, using both types of guide elements, one side of the corner of the platform support including column 1, the frame girders 3 and the guide tubes, of which only tube 5 is visible. At the lower end, a guide bushing 20 is illustrated as having an inlet funnel 21. More funnels of this kind may be present at the lower end of the support structures, being disposed about a ring (not shown).

Figure 5:
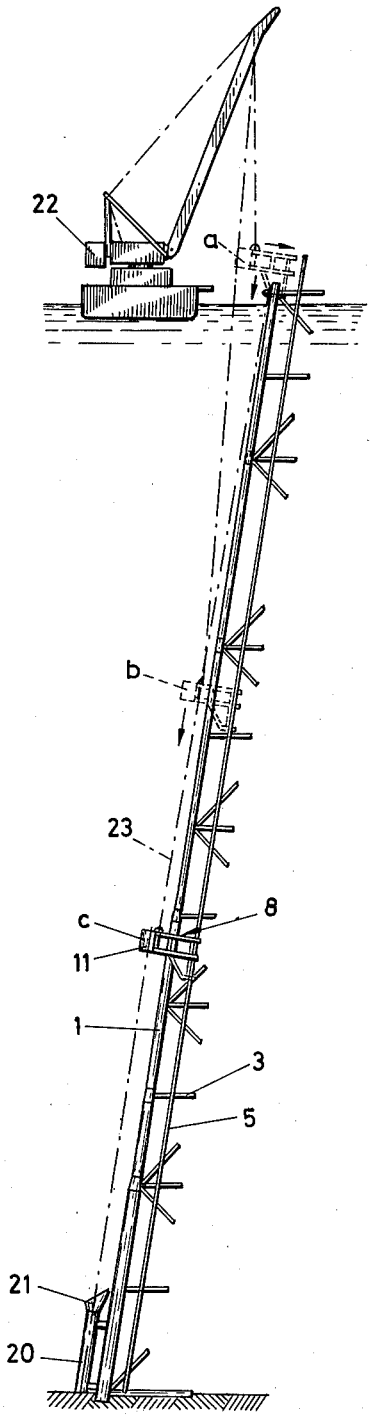
FIGS. 5 to 11 inclusive are side elevation views of the invention showing the various stages of anchoring a support structure.

The guide element 8 is lowered with the aid of a floating crane 22. FIG. 5 shows the positions *a*, *b* and *c*, in which *c* is the final position in which the guide element 8 rests on guide tubes 4, 5 and is kept in the right position with the aid of cable 23.

Figure 6:
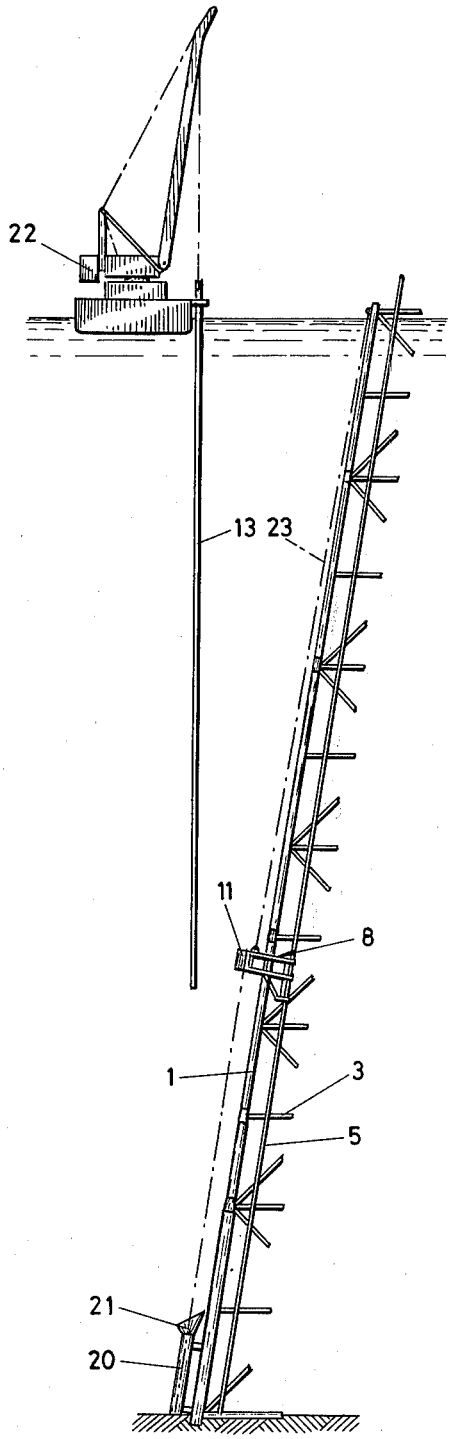
Figure 7:
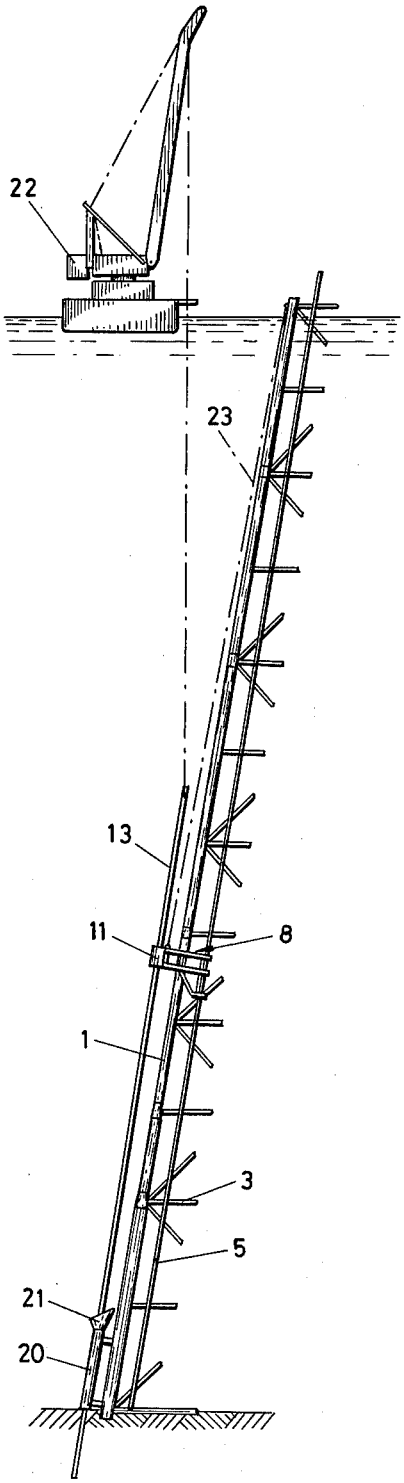

FIG. 6 illustrates the manner in which a pile with a length of e. g. 100 meters may be lowered in the manner illustrated in FIG. 7, said pile after having been taken from a container being suspended at the side of the crane vessel 22. As soon as the lower end portion has entered the funnel 21, the pile may be positioned in the chair 11 of the guide element 8, whereby part of the pile will be lowered into the ground by its own weight.

Figure 8:
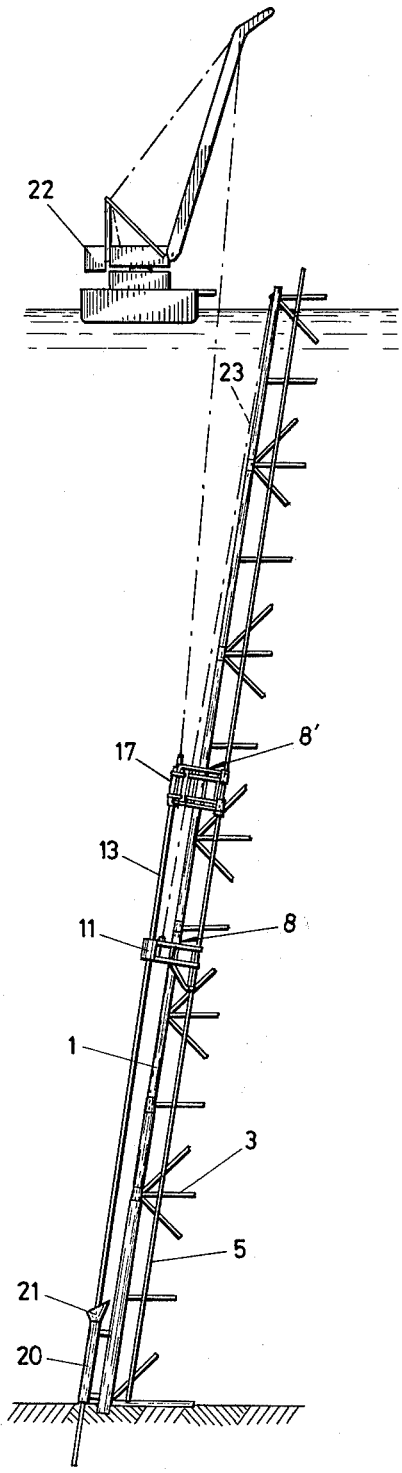
Figure 9:
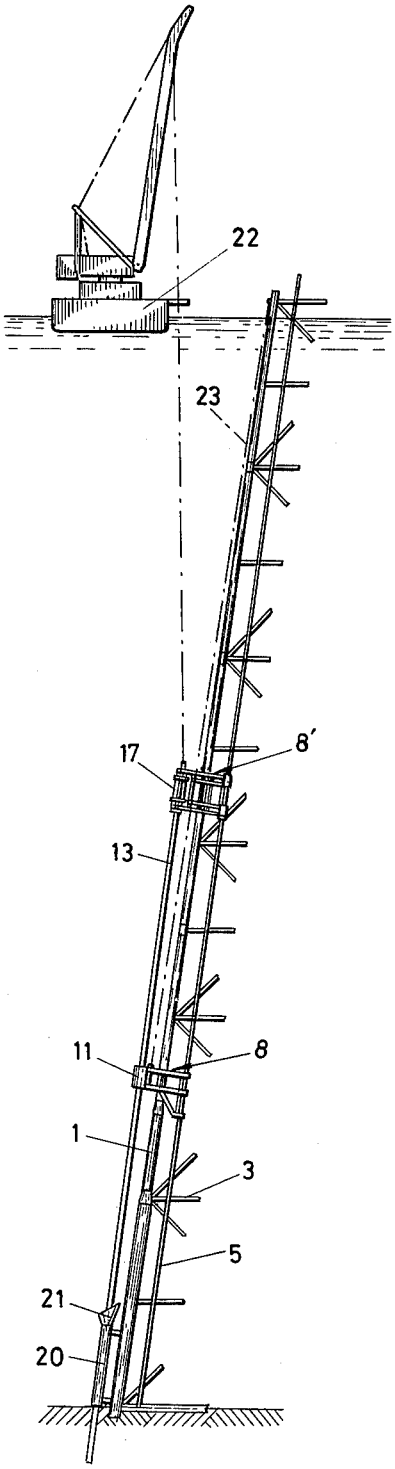

As illustrated in FIG. 8, a second guide element 8′ is then lowered with pile hammer 17 until the pile hammer embraces the head of the pile. Subsequently, the first guide element 8 is placed in the right position (see FIG. 9) which is essential for taking the transverse loads, which means a position halfway up the free height of the pile 18 extending above the ground.

Figure 10:
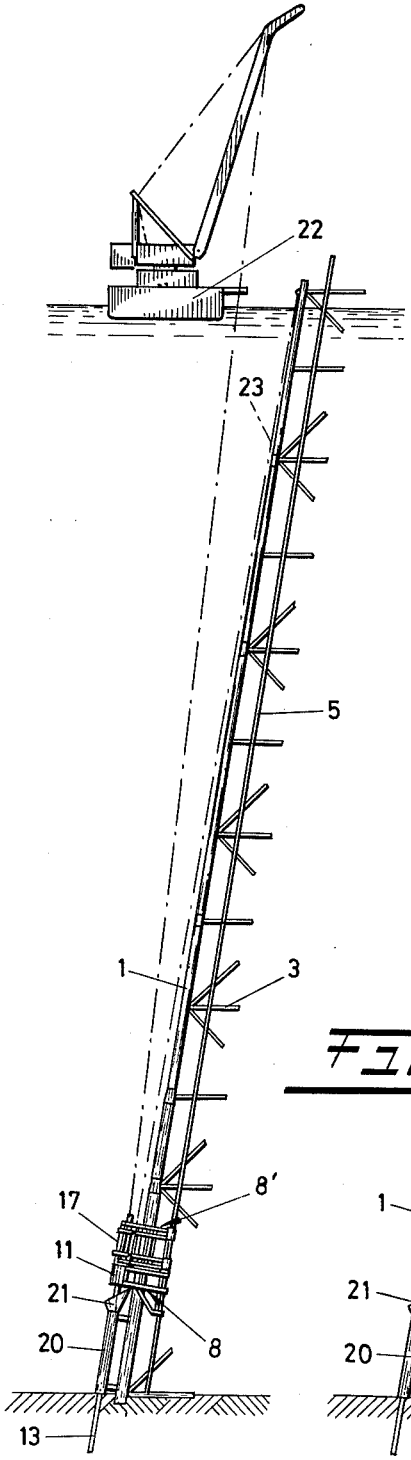
Figure 11:
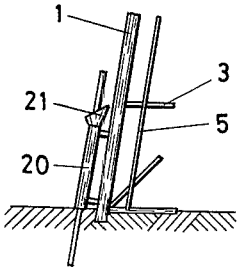

FIG. 10 illustrates the positions of the componentry at the end of the pile driving process and FIG. 11 the final position when all pile driving and guide means have been removed. During the process of pile driving, the first guide element 8 is always present halfway up the height of the pile which is present above the ground (see FIG. 9).

It will be evident that the guide elements 8 and 8′ may take other positions, and a third guide element or even more may be employed, for example at one third or two thirds of that length while using several guide elements.

When several piles have been positioned before one starts driving one pile into the ground, it is desirable, after a certain length of one pile has been driven into the ground, and, therewith, that the guide element 8 or guide elements 8 and 8′ are moved downwards accordingly, to give the freely extending end portions of the other piles a support by positioning another guide element of the same type as guide element 8 or 8′ but which is disposed above that guiding device such as device 8, which carries the pile hammer 17. The latter added guide elements should be removed each time when the pile hammer is shifted to the next pile.

While the invention has been particularly shown and described with reference to a preferred embodiment thereof, it will be understood by those skilled in the art that various changes in form and details may be made therein without departing from the spirit and scope of the invention.

What is claimed is:

1. In a method for securing a platform support structure, such as a framework in the form of a truncated pyramid, onto the ocean floor with the aid of piles, including the steps of providing said support structure at the region of the corners with guide bushings through which the piles are inserted, and driving into the ground said piles by a ram disposed on the top of the pile, and which during the process of pile driving supporting the piles transversely by guide elements provided on the corner columns of the framework, the improvement comprising providing near each pile at least one guide element for supporting the pile at the region where the chance of bending and/or collapse is most likely and that during the process of pile driving the step of moving the guide element along said region to continuously support said pile as it is driven downwardly at said region of likely bending.

2. In a device for securing a platform support structure, such as a framework in the form of a truncated pyramid, onto the ocean floor by driving piles into the ocean floor adjacent thereto, said support structure comprising a number of guide bushings secured to the foot near the corners of the support structure, at least one guide element for each pile, said guide element being secured to the support structure in line with the center line of the appertaining bushing, means for lowering a pile, and a pile hammer for driving the pile downwardly at said corner, the improvement wherein the guide element is placed saddle-shaped across a main column or corner rib of the support structure with legs, present on the support structure at either side of the column or rib with said guide element in contact with an associated pile at a region of the pile where bending is most likely, and means for displacement said guide element in a direction parallel to the center line of the column or rib in unison with said pile driving movement, whereby said pile is continuously supported at the region of likely bending as it is being driven downwardly by said pile hammer.

3. The device in accordance with claim 2, further comprising tubes secured to the support structure parallel to the center line of the column or rib for guiding the legs of the guide element.

4. The device in accordance with claim 3, further comprising means on the outer ends of the legs of the guide element for embracing said tubes such that displacement of said guide elements is only possible parallel to said tubes.

5. The device in accordance with claim 2, wherein said guide elements are two in number and a pile hammer is secured to the upper guide element.

6. The device in accordance with claim 2, wherein each guide element is provided with several elements for accommodating a pile or pile hammer.

7. The device in accordance with claim 5, wherein said guide elements for the piles have V-shaped receiving elements oriented with the mouth of the V-shape in the same direction.

* * * * *